US005834699A

United States Patent [19]

Buck et al.

[11] Patent Number: 5,834,699

[45] Date of Patent: Nov. 10, 1998

[54] CABLE WITH SPACED HELICES

[75] Inventors: Arthur G. Buck, Sherwood; Ronald A. Olson, Portland, both of Oreg.

[73] Assignee: The Whitaker Corporation, Wilmington, Del.

[21] Appl. No.: 926,913

[22] Filed: Sep. 10, 1997

Related U.S. Application Data

[63] Continuation of Ser. No. 604,690, Feb. 21, 1996, abandoned.

[60] Provisional application No. 60/006,089 Oct. 31, 1995.

[51] Int. Cl.[6] ..... H01B 7/04

[52] U.S. Cl. ..... 174/113 R; 174/36

[58] Field of Search ..... 174/36, 107, 113 R, 174/113 A, 113 AS, 113 C, 131 A, 128.1

[56] References Cited

U.S. PATENT DOCUMENTS

| | | | |
|---|---|---|---|
| 1,009,030 | 11/1911 | Frederick | 174/128.1 |
| 1,348,033 | 7/1920 | Moon | 174/128.1 |
| 1,691,869 | 11/1928 | Fowle | 174/128.1 |
| 2,212,927 | 8/1940 | Baguley | 174/36 |
| 2,913,514 | 11/1959 | Short | 174/90 |
| 3,240,867 | 3/1966 | Maddox | 174/69 |
| 3,291,898 | 12/1966 | Sandell | 174/131 |
| 3,351,706 | 11/1967 | Gnerre et al. | 174/105 R |
| 3,484,532 | 12/1969 | Anderson | 174/36 |
| 3,602,632 | 8/1971 | Ollis | 174/36 |
| 3,602,636 | 8/1971 | Evans | 174/115 |
| 3,629,941 | 12/1971 | Wagele | 29/624 |
| 3,649,744 | 3/1972 | Coleman | 174/107 |
| 3,651,243 | 3/1972 | Hornor et al. | 174/113 R X |
| 3,676,576 | 7/1972 | Dubernet et al. | 174/113 R |
| 3,772,454 | 11/1973 | Donecker et al. | 174/113 R |
| 3,784,732 | 1/1974 | Whitfill, Jr. | 174/108 |
| 3,816,644 | 6/1974 | Giffel et al. | 174/115 |
| 3,829,603 | 8/1974 | Hansen et al. | 174/115 |
| 4,096,346 | 6/1978 | Stine et al. | 174/36 |
| 4,110,554 | 8/1978 | Moore et al. | 174/101.5 |
| 4,358,636 | 11/1982 | Ijff et al. | 174/103 |
| 4,398,058 | 8/1983 | Gerth et al. | 174/106 D |
| 4,440,974 | 4/1984 | Naudet | 174/106 D |
| 4,461,923 | 7/1984 | Bogese, II | 174/36 |
| 4,552,989 | 11/1985 | Sass | 174/103 |
| 4,677,418 | 6/1987 | Shulver | 174/102 R X |
| 4,691,081 | 9/1987 | Gpta et al. | 174/105 R X |
| 4,694,122 | 9/1987 | Visser | 174/106 R X |
| 4,761,519 | 8/1988 | Olson et al. | 174/107 |
| 5,212,350 | 5/1993 | Gebs | 174/102 R X |
| 5,220,130 | 6/1993 | Walters | 174/36 |
| 5,491,299 | 2/1996 | Naylor et al. | 174/36 |
| 5,521,333 | 5/1996 | Kobayashi et al. | 174/113 R |
| 5,523,528 | 6/1996 | Bese et al. | 174/36 |

*Primary Examiner*—Kristine L. Kincaid
*Assistant Examiner*—Chau N. Nguyen
*Attorney, Agent, or Firm*—Gerald K. Kita

[57] ABSTRACT

A flexible and limp cable (1) is constructed with: an outer jacket (2) containing at least one row of adjacent insulated conductors (3) circumferentially encircling an elongated axis lengthwise of the cable (1), and conductive drain wires (4) in selected interstitial spaces along the adjacent insulated conductors (3), the insulated conductors (3) and the drain wires (4) extending helically along the axis, and a conductive membrane (7) circumferentially enclosing the insulated conductors (3) and the drain wires (4), and the membrane (7) engaging the drain wires (4).

10 Claims, 3 Drawing Sheets

CABLE WITH SPACED HELICES

This application is a continuation of application Ser. No. 08/604,690 filed Feb. 21, 1996, now abandoned claiming the benefit of provisional application Ser. No. 60/006,089, filed Oct. 31, 1995, now abandoned.

FIELD OF THE INVENTION

The present invention relates to a flexible cable assembly suitable for connection to a hand held, medical instrument, and more particularly, to a bundle of highly flexible conductors that provide a low cost, highly flexible cable assembly.

BACKGROUND OF THE INVENTION

U.S. Pat. No. 4,761,519 discloses a flexible cable comprising, a bundle of multiple coaxial cables of flexible and limp construction. The flexible cable is suitable for connection to a hand held, medical instrument for monitoring human physiological indications during diagnostic and surgical procedures. Each coaxial cable is flexible and limp, and is constructed with a conductive shield encircling concentrically a dielectric sheath, in turn, encircling a central conductor to provide a controlled electrical impedance. Each coaxial cable in use transmits electronic signals along the central conductor. The braided wire shielding substantially reduces cross talk among the adjacent coaxial cables, and contributes to controlling the characteristic impedance of each coaxial cable.

As disclosed by the patent, braided wire shielding on the flexible cable is constructed in an advantageous manner to provides reduced resistance to movement of the cable in axial and rotational directions. A major cost of the cable resides in the consumption of time and materials for applying braided wire shielding on each coaxial cable. In the past, the braided wire shielding has been necessary to prevent unacceptable levels of cross talk among the adjacent insulated conductors in the bundle, particularly when the medical instruments involve radio frequency signals.

The field of diagnostic medical instruments is undergoing a trend to involve either radio frequency signals or ultrasound frequency signals. Because ultrasound signals are slower in speed and have lengthy time durations, as compared with radio frequency signals, it would be advantageous to discover a cable construction that reduces cross talk among signal carrying conductors in the cable without surrounding each of the signal carrying conductors with braided wire shielding. A lower cost cable would be constructed of insulated wires with a featured construction other than expensive braided wire shielding to reduce cross talk to acceptable levels.

Accordingly, a need exists for a flexible cable that eliminates braided wire shielding to reduce the cost of manufacturing, and which cable yet provides an acceptable, reduced level of cross talk among the individual signal carrying conductors in the cable.

SUMMARY OF THE INVENTION

According to the invention, a flexible and limp cable is capable of connection to a medical instrument, and remains flexible and limp to permit freedom of movement of the medical instrument as the instrument is hand held and maneuvered.

According to an embodiment, a flexible and limp cable has a construction that comprises, multiple insulated conductors and drain wires, the drain wires extending in selected interstitial spaces among the insulated conductors to reduce cross talk among the insulated conductors in the bundle, and the insulated conductors and the drain wires extending helically along a lengthwise axis of the cable.

DESCRIPTION OF THE DRAWINGS

Embodiments of the invention will now be disclosed by way of example with reference to the accompanying drawings, according to which.

DETAILED DESCRIPTION

Figure 1:
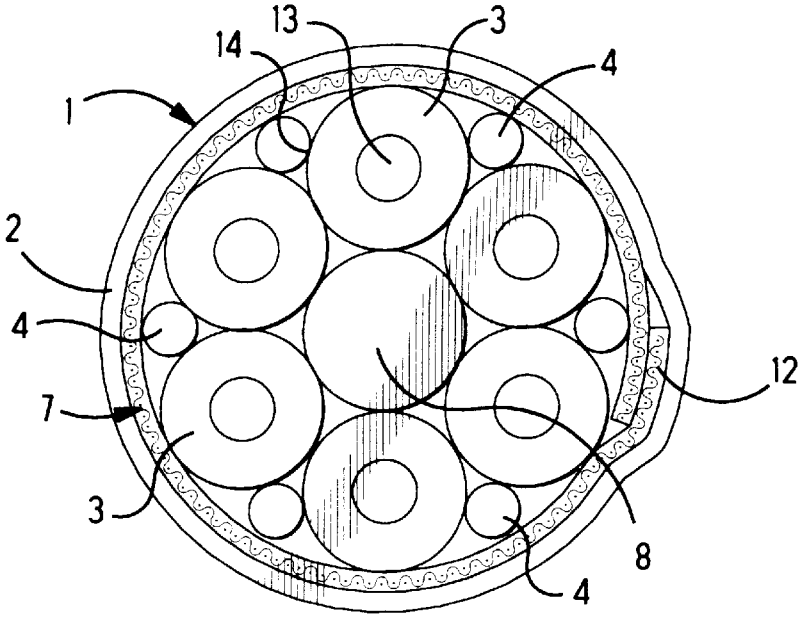
FIG. 1 is an end view of a limp and flexible cable.
Figure 2:
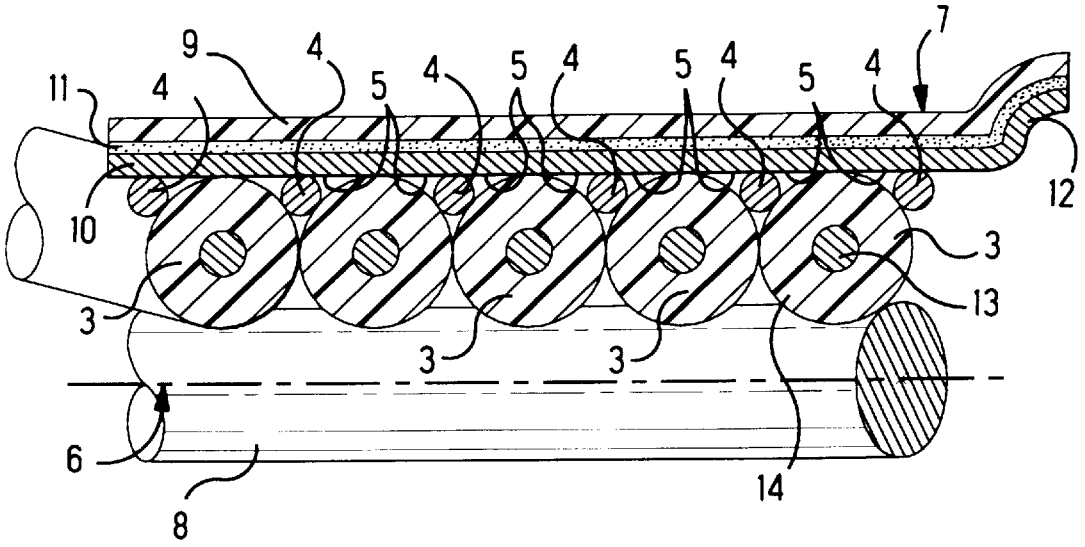
FIG. 2 is a diagrammatic view of the cable shown in FIG. 1, with parts separated from one another.

With reference to FIGS. 1 and 3–5, a flexible cable 1 comprises, an outer jacket 2 containing multiple insulated wires or conductors 3 and uninsulated, conductive drain wires 4 in respective interstitial spaces 5, FIG. 2, among the insulated conductors 3. The insulated conductors 3 are arranged side by side in a line, with the line encircling a corresponding axis 6, FIG. 2, extending lengthwise of the cable 1. The insulated conductors 3 of the row are adjacent one another and are enclosed within an encircling hollow tube constructed of a conductive membrane 7. The membrane 7 retains the insulated conductors 3 in a row, side by side, with the row extending in a line encircling the axis 6. The membrane 7 and the drain wires 4 engage, with the membrane 7 providing an electrical ground plane, or ground bus, that engages the drain wires 4.

Figure 3:
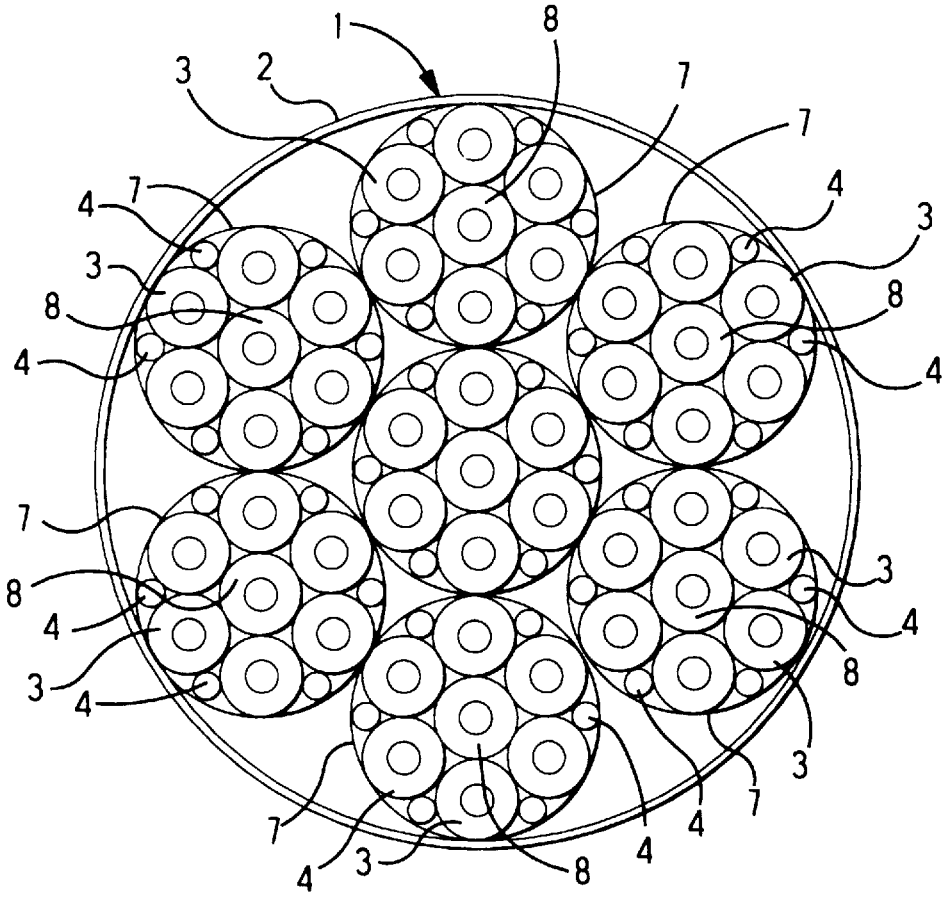
FIG. 3 is an end view of a flexible and limp cable assembled with multiple parts that are shown in FIG. 2.

The axis 6 comprises, a cylindrical air space, not shown, or a flexible wire 8 of enlarged diameter as compared with the diameter of each of the individual insulated wires 3. The wire 8 can be conductive material, e.g., copper covered steel, stainless steel on high strength copper alloy. The wire 8 can be bare, as shown in FIG. 2, or can be covered with concentric insulation, as shown in FIG. 3. The axis 6 can also comprise a combination of an air space, not shown, encircling a wire. An axis 6 comprised of air enhances flexibility of the cable 1, because air is without frictional resistance to bending of the insulated wires 3 and the drain wires 4. The advantage of an axis comprised of a wire 8 resides in the wire 8 being capable of carrying and resisting tension loads applied to the cable 1. Internal strain on the cable 1 is borne by the wire 8, while the insulated conductors 3 and the drain wires 4 can be limp and freed from excessive strain. Thus, the insulated conductors 3 can be smaller in diameter or reduced in tensile strength, as compared to previous cable constructions. For example, wire of silver plated copper, SPC, of solid gauge can be used as a less costly alternative to the use of conductors fabricated from higher strength copper alloys, and conductors fabricated of multiple strands instead of a single solid strand.

A selected number of insulated conductors 3, having the same diameter size, side by side in the row completely encircles the axis 6. All of the insulated conductors 3 in the row are laid over the axis 6, and extend helically along the axis 6. The helical lay of the insulated conductors 3 provides a high degree of flexibility and a reduced resistance to flexure of the cable 1 in a bend. Selected drain wires 4 are laid in respective interstitial spaces 5 along and beside adjacent insulated conductors 3 in the row.

It is important that the insulated conductors 3 and drain wires 4 are free of compression against one another, so as to promote their individual flexure when the cable 1 undergoes flexure in a bend. Accordingly, air surrounds each of the conductors 3 and 4 to provide a gap within which the conductors 3 and 4 are free to move during flexure of the cable 1 in a bend. A gap in the line of the row of insulated conductors 3 may be allowed. For example, when the insulated conductors 3 engage one another, a gap in the line of the row is permitted, so long as the gap has a width less than the diameter of the smallest diameter of one of the insulated conductors 3. The selected number of insulated conductors 3 side by side is selected to correspond with the largest number of the insulated conductors 3 that fits along a circumferential line that passes through the diameters of said insulated conductors 3 and that completely encircles the axis. Thus, a width of the gap on the circumferential line will be less than the diameter of one of the insulated conductors 3.

The flexible conductive membrane 7 encloses the row of insulated conductors 3. The membrane 7 limits movement of the insulated conductors 3 from out of their positions within the line of the row. The membrane 7 is constructed, for example, as a flexible laminate of a flexible polyester tape 9, FIG. 2, and a conductive aluminum foil 10 bonded together by an adhesive 11. The conductive foil 10 of the membrane 7 faces the insulated conductors 3. The membrane 7 limits spreading apart of adjacent conductors 3 to prevent falling of the drain wires 4 away from engagement with the conductive portion of the membrane 7. The membrane 7 is laid over the insulated wires 3 and the selected drain wires 4. The membrane can be cylindrical with an overlapped seam 12, FIG. 2, formed by a flap on the membrane 7. Alternatively the membrane 7 comprises overlapping helices enclosing the row of adjacent conductors 3, the overlapped seam 12 overlapping the adjacent helices with one another.

An interstitial space 5, FIG. 2, is located beside and along each pair of adjacent insulated conductors 3. The drain wires 4 are in respective interstitial spaces 5 beside and along corresponding pairs of adjacent insulated conductors 3. Each drain wire 4 has a diameter to bridge between and to contact both of the adjacent insulated conductors 3. Each drain wire 4 is in contact with first and second points, which points are in contact with respective adjacent insulated conductors 3.

Each drain wire 4 is in contact with a third point on an arc that is concentric with the conductive surface of the encircling membrane 7. Even for the smallest diameter drain wire 3, the third point will be tangent to the circumference of such a drain wire 3. For a larger diameter drain wire 3, the third point will be bulged out against the conductive surface of the encircling membrane 7.

The electrical impedances and reduction in cross talk of adjacent insulated conductors 3, in the past, have been controlled by a conducting shield, not shown, that encircled a corresponding insulated conductor 3 to provide a coaxial cable construction. With respect to the embodiments of the cable 1, FIG. 2, in the absence of an encircling conducting shield, the drain wire 4 and a central wire 13 or conductor of a corresponding insulated conductor 3 are parallel, and are spaced apart by concentric insulation 14 encircling the central conductor 13. The insulation 14 is in contact with the drain wire 4 and with the membrane 7. During transmission of electrical signals along the conductor 13, an electrical coupling influence between the helically wound conductor 13 and the helically wound drain wire 4 will remain constant along the entire lengths in parallel of the conductor 13 and drain wire 4. Accordingly, a desired electrical impedance and a reduction in cross talk is obtained with the construction of the cable 1.

A cable 1 with one row of insulated conductors 3 is shown in FIG. 1. Each of FIGS. 3, 4 and 5, shows a cable 1 with multiple rows of insulated conductors 3, with an insulating membrane 7 separating one row from another row.

Figure 4:
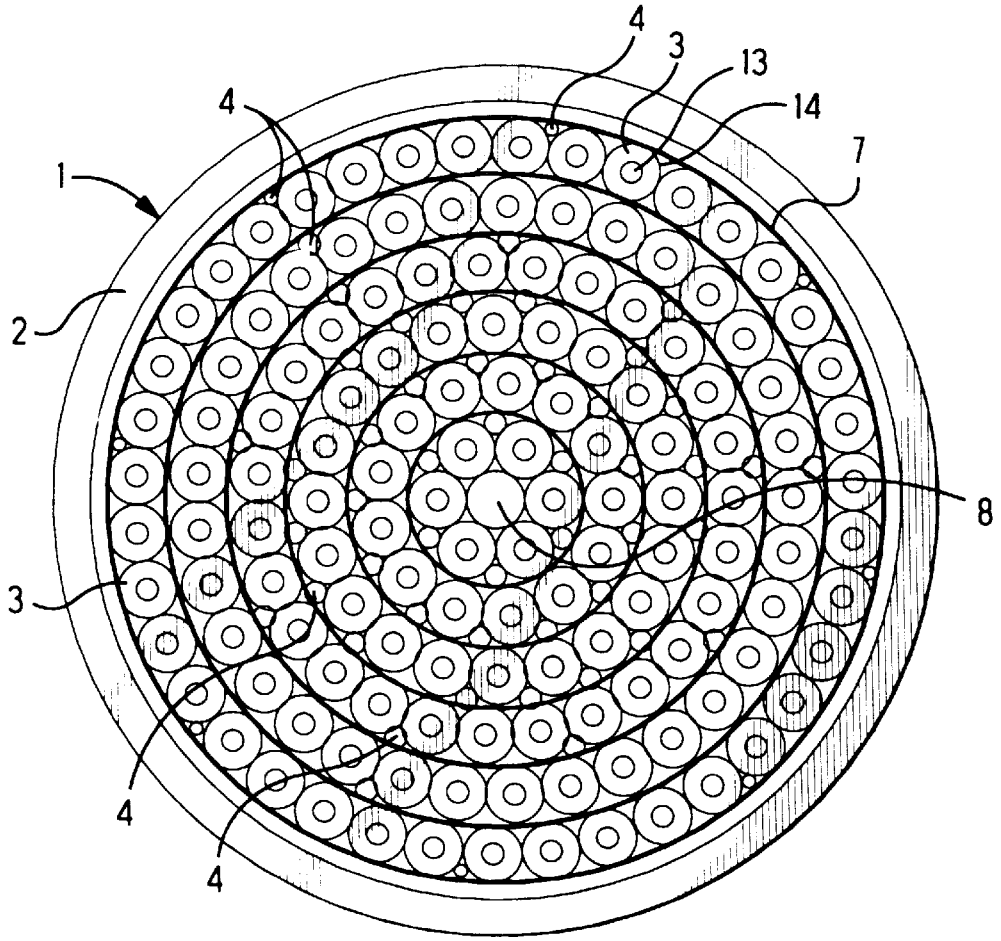
FIG. 4 is an end view of a flexible and limp cable assembled with multiple parts that are shown in FIG. 2.
Figure 5:
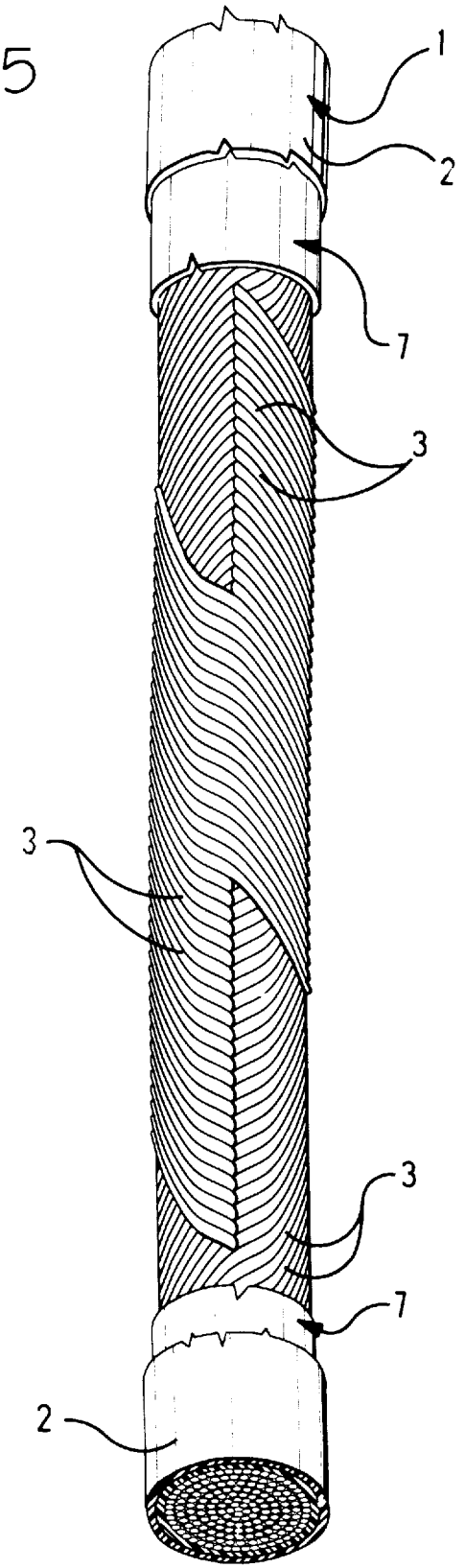
FIG. 5 is a side view of another cable assembly with parts broken away.

Each of FIGS. 3, 4 and 5, shows a cable 1 comprising: the outer jacket 2 containing at least a second row of adjacent insulated conductors 3 circumferentially encircling a second axis 6, and at least a second conductive membrane 7 circumferentially enclosing the insulated conductors 3 in the second row, and conductive additional drain wires 4 in selected interstitial spaces along the adjacent insulated conductors 3 in said second row, the additional drain wires 4 engaging the second conductive membrane 7.

Each of FIGS. 4 and 5 shows a cable 1 comprising: the outer jacket 2 containing successive rows of adjacent insulated conductors 3 circumferentially encircling an axis 6 lengthwise of the cable 1, wherein respective conductive flexible membranes 7 encircle respective rows, and conductive drain wires 4 in selected interstitial spaces along adjacent pairs of the insulated conductors 3 engage respective membranes 7. Each successive row of insulated conductors 3 can be laid in helices with alternating pitch directions or, alternatively, the same pitch directions, not shown.

Other embodiments and modifications are intended to be covered by the spirit and scope of the appended claims.

What is claimed is:

1. An electrical cable comprising:

signal carrying insulated conductors extending side by side in a row, each of the insulated conductors being without an encircling conducting shield that would provide a coaxial cable construction, a conductive membrane enclosing the row, the conductive membrane providing an electrical ground plane, conductive drain wires in selected interstitial spaces along the insulated conductors, the drain wires and the conductive membrane engaging and reducing cross talk among the insulated conductors without said encircling conducting shield on each of the insulated conductors that would provide said coaxial cable construction, and the conductive membrane being contained within an exterior jacket, the insulated conductors and the drain wires being wound helically along a central axis of the cable with the insulated conductors and the drain wires being free of compression against one another so as to promote their individual flexure when the cable undergoes flexure in a bend, an electrical coupling influence between each of said helically wound drain wires and each corresponding one of said helically wound insulated conductors remaining constant along their lengths, and the cable being flexible and limp and having freedom of movement while being connected to a medical instrument that is hand held and maneuvered for monitoring human indications.

2. An electrical cable as recited in claim 1 wherein, the conductive membrane comprises overlapping helices enclosing said row.

3. An electrical cable as recited in claim 1 wherein, the conductive membrane is cylindrical with an overlapped seam.

4. An electrical cable as recited in claim 1 and further comprising: the number of said insulated conductors in said row corresponding to the largest number of said insulated conductors that fits along a circumferential line that passes through the diameters of said insulated conductors and that completely encircles said central axis, a gap in said row, a width of the gap on said circumferential line being narrower than each of the diameters of the insulated conductors extending side by side in the row.

5. An electrical cable as recited in claim 1 and further comprising:

at least another row of adjacent insulated conductors encircling said conductive membrane, at least another conductive membrane circumferentially enclosing said another row, said another conductive membrane limiting movement of the adjacent insulated conductors from out of their positions in said another row, and additional conductive drain wires in selected interstitial spaces along said adjacent insulated conductors, said another row being laid in helices encircling the axis with said adjacent insulated conductors in said another row being side by side, the additional drain wires engaging said another conductive membrane to reduce cross talk among said adjacent insulated conductors, the adjacent insulated conductors in said another row and said additional drain wires in said another row being wound helically over said conductive membrane with the adjacent insulated conductors and the additional drain wires being free of compression against one another and undergoing individual flexure when the cable undergoes flexure, and said another conductive membrane being contained within said exterior jacket.

6. An electrical cable as recited in claim 5 wherein, the helices of respective said rows are laid in alternate pitch directions.

7. An electrical cable as recited in claim 5 wherein, the helices of said rows are laid in the same pitch directions.

8. An electrical cable as recited in claim 5 wherein, said another conductive membrane comprises overlapping helices enclosing said another row of said adjacent insulated conductors.

9. An electrical cable as recited in claim 5 wherein, said another conductive membrane is cylindrical with an overlapped seam.

10. An electrical cable as recited in claim 5 and further comprising: a gap in said another row of the adjacent insulated conductors, the gap being narrower than each diameter of the adjacent insulated conductors.

* * * * *